US005997419A

United States Patent [19]

Daniels et al.

[11] Patent Number: 5,997,419

[45] Date of Patent: Dec. 7, 1999

[54] BALL HITTING PRACTICE DEVICE

[76] Inventors: David Daniels, 207 Reynolds St., Orange, N.J. 07050; Elton Wilson, Kleinpolderlaan 191, 2911 PB Nieuwerkerk A/D Ijssel, Netherlands

[21] Appl. No.: 09/090,323

[22] Filed: Jun. 4, 1998

[51] Int. Cl.[6] ..... A63B 69/00

[52] U.S. Cl. ..... 473/423

[58] Field of Search ..... 473/416, 417, 473/419, 422, 423, 424, FOR 102, FOR 103

[56] References Cited

U.S. PATENT DOCUMENTS 5,618,039 4/1997 Tsai .

*Primary Examiner*—Jeanette Chapman
*Assistant Examiner*—Vic Merdantte

[57] ABSTRACT

A ball hitting practice device for baseball batting practice. The device includes a base frame for resting on a ground surface. A base plate is slidably mounted to the base frame. A telescopically extendable elongate support leg is upwardly extended from the base plate. A pulley mounting plate is coupled to the upper end of the support leg. An upper mounting housing is coupled to the upper surface of the pulley mounting plate. The proximal end of a pivot arm is pivotally coupled to the top panel of the upper mounting housing. The pivot arm is extendable along a straight line extending generally parallel to the sides of the mounting housing. The pivot arm has proximal and distal portions pivotally coupled together at a joint. A ball is coupled to the distal end of the pivot arm. The pivot arm is biased towards the straight line when pivot arm is pivoted away from the straight line.

10 Claims, 5 Drawing Sheets

BALL HITTING PRACTICE DEVICE

BACKGROUND OF THE INVENTION

1. Field of the Invention

The present invention relates to ball hitting practice devices and more particularly pertains to a new ball hitting practice device for baseball batting practice.

2. Description of the Prior Art

The use of ball hitting practice devices is known in the prior art. More specifically, ball hitting practice devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art ball hitting practice devices include U.S. Pat. No. 4,907,801; U.S. Pat. No. 5,435,545; U.S. Pat. No. 4,830,371; U.S. Pat. No. 5,203,558; U.S. Pat. No. 5,273,277; and U.S. Pat. No. Des. 339,393.

While these devices fulfill their respective, particular objectives and requirements, the aforementioned patents do not disclose a new ball hitting practice device. The inventive device includes a base frame for resting on a ground surface. A base plate is slidably mounted to the base frame. A telescopically extendable elongate support leg is upwardly extended from the base plate. A pulley mounting plate is coupled to the upper end of the support leg. An upper mounting housing is coupled to the upper surface of the pulley mounting plate. The proximal end of a pivot arm is pivotally coupled to the top panel of the upper mounting housing. The pivot arm is extendable along a straight line extending generally parallel to the sides of the mounting housing. The pivot arm has proximal and distal portions pivotally coupled together at a joint. A ball is coupled to the distal end of the pivot arm. The pivot arm is biased towards the straight line when pivot arm is pivoted away from the straight line.

In these respects, the ball hitting practice device according to the present invention substantially departs from the conventional concepts and designs of the prior art, and in so doing provides an apparatus primarily developed for the purpose of baseball batting practice.

SUMMARY OF THE INVENTION

In view of the foregoing disadvantages inherent in the known types of ball hitting practice devices now present in the prior art, the present invention provides a new ball hitting practice device construction wherein the same can be utilized for baseball batting practice.

The general purpose of the present invention, which will be described subsequently in greater detail, is to provide a new ball hitting practice device apparatus and method which has many of the advantages of the ball hitting practice devices mentioned heretofore and many novel features that result in a new ball hitting practice device which is not anticipated, rendered obvious, suggested, or even implied by any of the prior art ball hitting practice devices, either alone or in any combination thereof.

To attain this, the present invention generally comprises a base frame for resting on a ground surface. A base plate is slidably mounted to the base frame. A telescopically extendable elongate support leg is upwardly extended from the base plate. A pulley mounting plate is coupled to the upper end of the support leg. An upper mounting housing is coupled to the upper surface of the pulley mounting plate. The proximal end of a pivot arm is pivotally coupled to the top panel of the upper mounting housing. The pivot arm is extendable along a straight line extending generally parallel to the sides of the mounting housing. The pivot arm has proximal and distal portions pivotally coupled together at a joint. A ball is coupled to the distal end of the pivot arm. The pivot arm is biased towards the straight line when pivot arm is pivoted away from the straight line.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ball hitting practice device apparatus and method which has many of the advantages of the ball hitting practice devices mentioned heretofore and many novel features that result in a new ball hitting practice device which is not anticipated, rendered obvious, suggested, or even implied by any of the prior art ball hitting practice devices, either alone or in any combination thereof.

It is another object of the present invention to provide a new ball hitting practice device which may be easily and efficiently manufactured and marketed.

It is a further object of the present invention to provide a new ball hitting practice device which is of a durable and reliable construction.

An even further object of the present invention is to provide a new ball hitting practice device which is susceptible of a low cost of manufacture with regard to both materials and labor, and which accordingly is then susceptible of low prices of sale to the consuming public, thereby making such ball hitting practice device economically available to the buying public.

Still yet another object of the present invention is to provide a new ball hitting practice device which provides in the apparatuses and methods of the prior art some of the advantages thereof, while simultaneously overcoming some of the disadvantages normally associated therewith.

Still another object of the present invention is to provide a new ball hitting practice device for baseball batting practice.

Yet another object of the present invention is to provide a new ball hitting practice device which includes a base frame for resting on a ground surface. A base plate is slidably mounted to the base frame. A telescopically extendable elongate support leg is upwardly extended from the base plate. A pulley mounting plate is coupled to the upper end of the support leg. An upper mounting housing is coupled to the upper surface of the pulley mounting plate. The proximal end of a pivot arm is pivotally coupled to the top panel of the upper mounting housing. The pivot arm is extendable along a straight line extending generally parallel to the sides of the mounting housing. The pivot arm has proximal and distal portions pivotally coupled together at a joint. A ball is coupled to the distal end of the pivot arm. The pivot arm is biased towards the straight line when pivot arm is pivoted away from the straight line.

Still yet another object of the present invention is to provide a new ball hitting practice device that permits repeated hitting of the ball in seconds.

Even still another object of the present invention is to provide a new ball hitting practice device that is easily adjustable to conform to all sizes of batters and for both left and right handed batters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
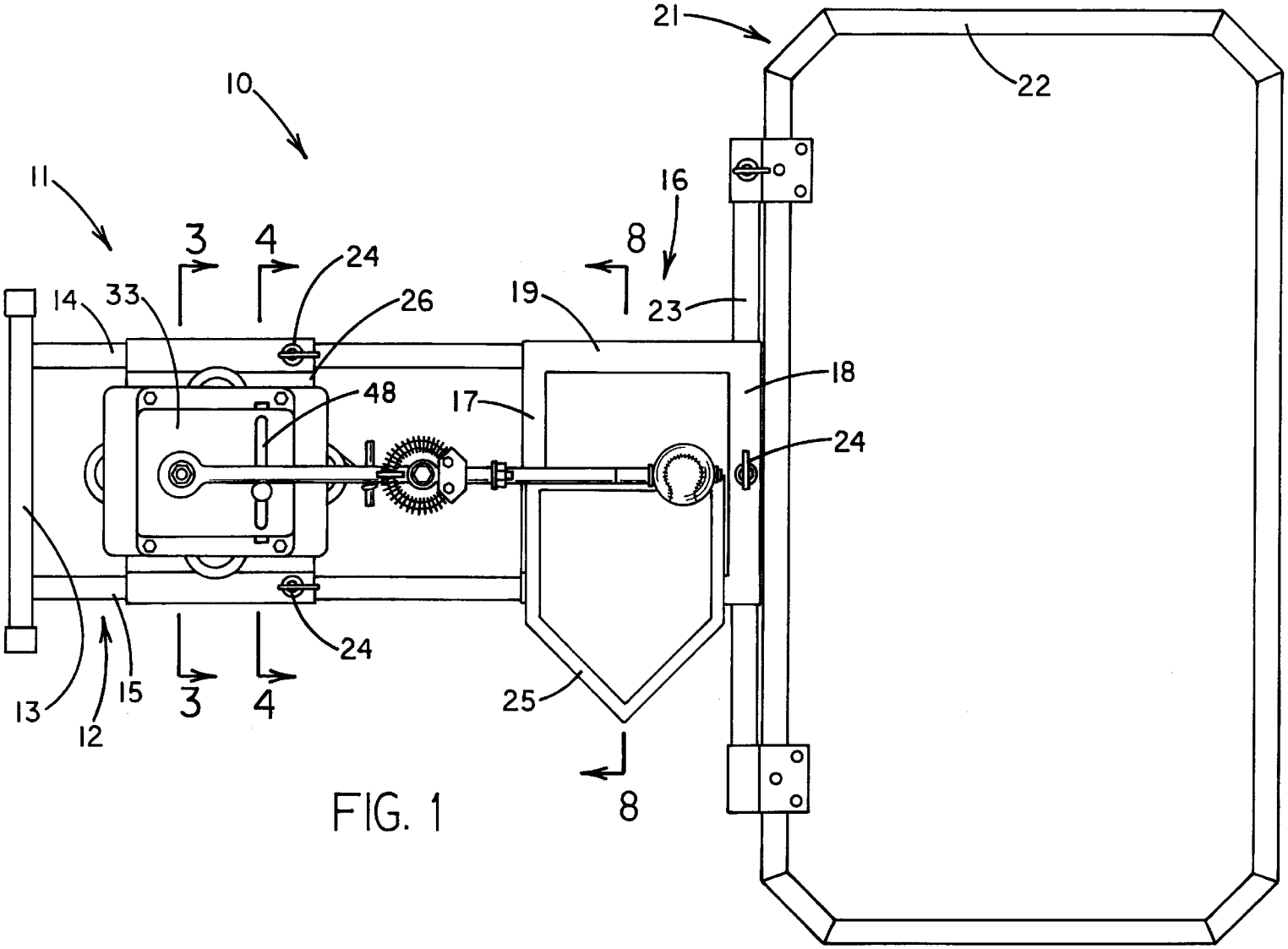
FIG. 1 is a schematic top plan view of a new ball hitting practice device according to the present invention.

With reference now to the drawings, and in particular to FIGS. 1 through 10 thereof, a new ball hitting practice device embodying the principles and concepts of the present invention and generally designated by the reference numeral 10 will be described.

As best illustrated in FIGS. 1 through 10, the ball hitting practice device 10 generally comprises a base frame 11 for resting on a ground surface. A base plate 26 is slidably mounted to the base frame 11. A telescopically extendable elongate support leg 27 is upwardly extended from the base plate 26. A pulley mounting plate 31 is coupled to the upper end of the support leg 27. An upper mounting housing 32 is coupled to the upper surface of the pulley mounting plate 31. The proximal end 36 of a pivot arm 35 is pivotally coupled to the top panel 33 of the upper mounting housing 32. The pivot arm 35 is extendable along a straight line extending generally parallel to the sides of the mounting housing 32. The pivot arm 35 has proximal and distal portions 38,39 pivotally coupled together at a joint 40. A ball 41 is coupled to the distal end 37 of the pivot arm 35. The pivot arm 35 is biased towards the straight line when pivot arm 35 is pivoted away from the straight line.

With reference to FIG. 1, the base frame 11 is designed for resting on a ground surface. The base frame 11 preferably has a first end frame 12, a second end frame 21, and a middle frame 16 interposed between the first and second end frames. Preferably, the frames 12,21,16 are generally coplanar. The first end frame 12 is generally U-shaped and has an elongate end rail 13 and a pair of spaced apart elongate side rails 14,15 outwardly extending from one side of the end rail 13 of the first end frame 12. Preferably, the rails of the first end frame 12 comprise rectangular tubes. The side rails 14,15 of the first end frame 12 each has a pair of opposite ends. One of the ends of each of the side rails 14,15 of the first end frame 12 is coupled to the end rail 13 of the first end frame 12. The lengths of the side rails 14,15 of the first end frame 12 are generally parallel to each other and are also generally perpendicular to the length of the end rail 13 of the first end frame 12.

The middle frame 16 is generally rectangular and has a pair a pair of end bars 17,18 and a pair of side bars 19,20 between the end bars 17,18 of the middle frame 16. Preferably, the bars of the middle frame 16 comprise rectangular tubes. The middle frame 16 has a pair of holes with one hole of the middle frame 16 extending into each of the side bars 19,20. The holes are positioned adjacent one of the end bars 17,18 of the middle frame 16. The other ends of the side rails 14,15 of the first end frame 12 are slidably inserted into these holes of the middle frame 16 with one of the side rails 14,15 of the first frame is inserted into one of the holes of the middle frame 16 and another of the side rails 14,15 of the first frame is inserted into another of the holes of the middle frame 16. The middle frame 16 also has an bore extending through another of the end bars 17,18 between the side bars 19,20 of the middle frame 16.

The second end frame 21 has a stage platform 22 and an elongate slide rod 23. The stage platform 22 of the second end frame 21 is generally rectangular and has a generally planar upper surface, a pair of end edges and a pair of side edges extending between the end edges of the stage platform 22. The stage platform 22 is designed for standing on by a user. The slide rod 23 of the second end platform has pair of opposite ends. The slide rod is slidably extended through the bore of the middle frame 16 such that the ends of the slide rod 23 extend from opposite side bars 19,20 of the middle frame 16. The ends of the slide rod 23 of the second end frame 21 are coupled to one of the side edges of the stage platform 22 of the second end frame 21. Preferably, a first holding device 24 such as a threaded holding screw is provided for releasably holding the slide rod 23 of the second end frame 21 in a position with respect to the middle frame 16.

Figure 8:
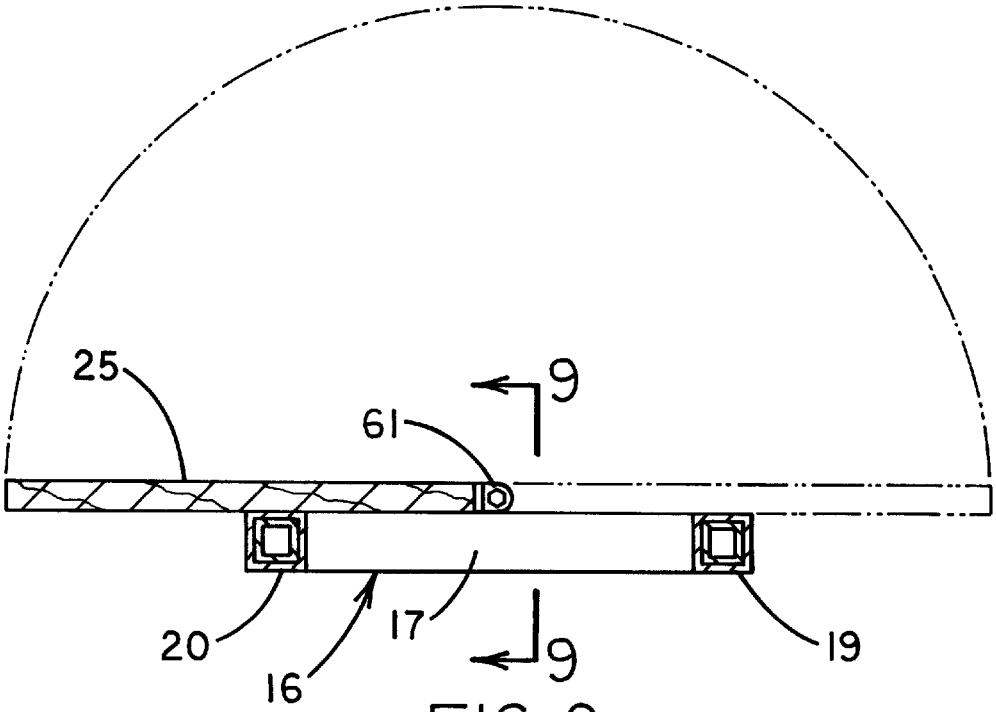
FIG. 8 is a schematic cross-sectional view of the present invention taken from line 8—8 of FIG. 1.
Figure 9:
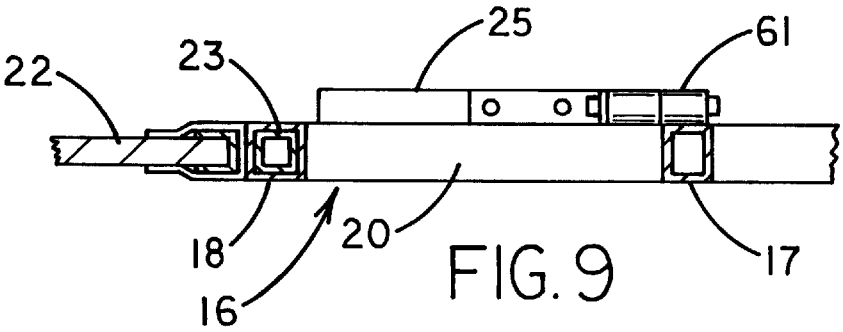
FIG. 9 is a schematic cross-sectional view of the present invention taken from line 9—9 of FIG. 8.
Figure 10:
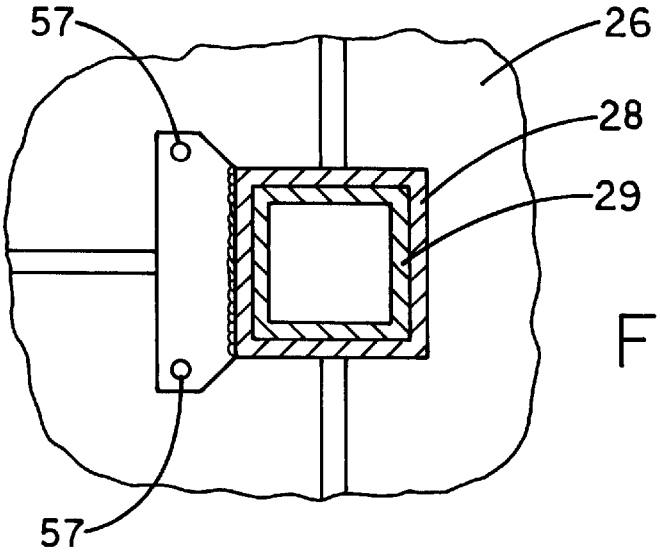
FIG. 10 is a schematic cross-sectional view of the present invention taken from line 10—10 on FIG. 2.

With reference to FIGS. 1, 8, and 9, a home plate member 25 is provided and has a front edge and a back vertex. The home plate member 25 rests on the middle frame 16 and is pivotally coupled 61 to one of the end bars 17,18 of the middle frame 16. The home plate member 25 is pivotable between a left handed position and a right handed position. In use, the back vertex of the home plate member 25 is outwardly extended away from one of the side bars 19,20 of the home plate member 25 when in the left handed position. The back vertex of the home plate member 25 is outwardly extended away from another of the side bars 19,20 of the home plate member 25 when in use in the right handed position.

Figure 6:
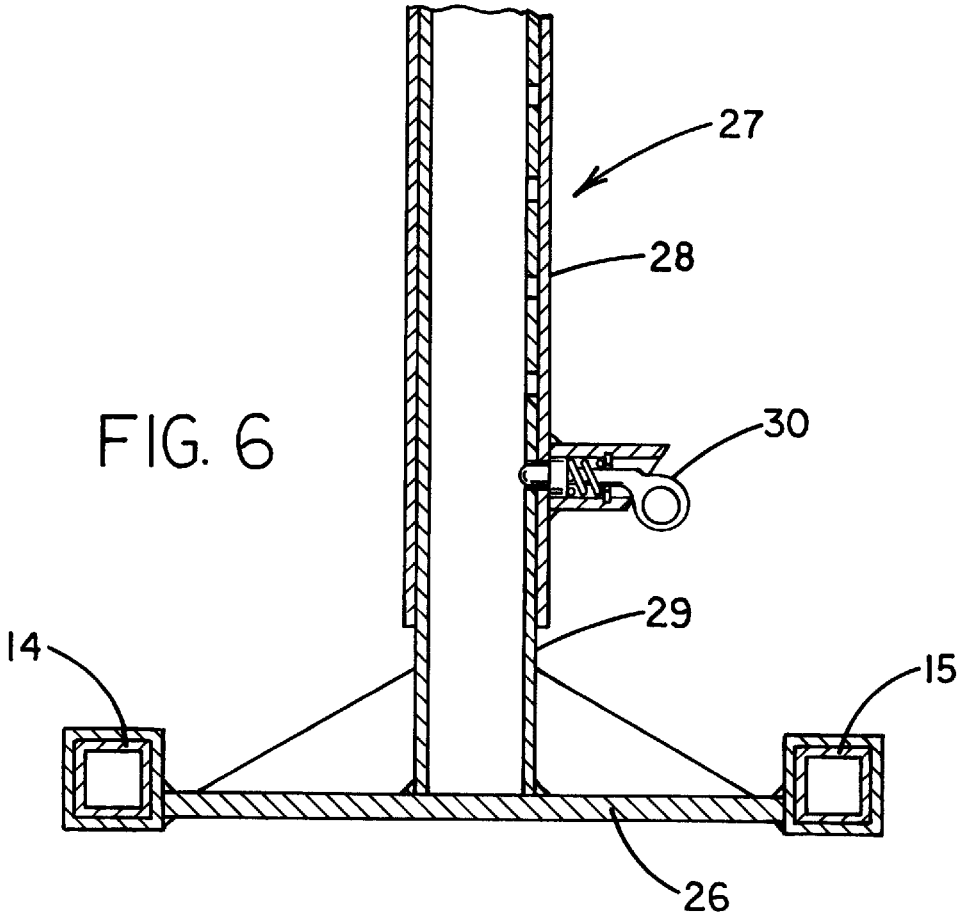
FIG. 6 is a schematic cross-sectional view of the present invention taken from line 6—6 on FIG. 2.

With reference to FIG. 6, the base plate 26 is generally rectangular and is slidably mounted on the side rails 14,15 of the first end frame 12 to permit sliding of the base plate 26 along the lengths of the side rails 14,15 of the first end frame 12. Preferably, the base plate 26 has a pair of side mounting tubes through which the side rails 14,15 of the first end frame 12 are slidably extended through. Ideally, a pair of holding devices 24 such as a threaded holding screw are provided for releasably holding the base plate 26 in position. The telescopically extendable elongate support leg 27 is upwardly extended from the base plate 26. The support leg 27 has upper and lower ends and a length extending between the ends of the support leg 27. The lower end of the support leg 27 is coupled to the upper surface of the base plate 26 with the length of the support leg 27 extended substantially perpendicularly to the plane of the base frame 11. Preferably, the support leg 27 has telescopic upper and lower portions 28,29, and a holding device 24 such as a spring biased holding pin 30 for holding the upper and lower portions 28,29 of the support leg 27 in a position with respect to each other to permit adjustment of the length, that is the height, of the support leg 27 to the appropriate height for the user.

Figure 3:
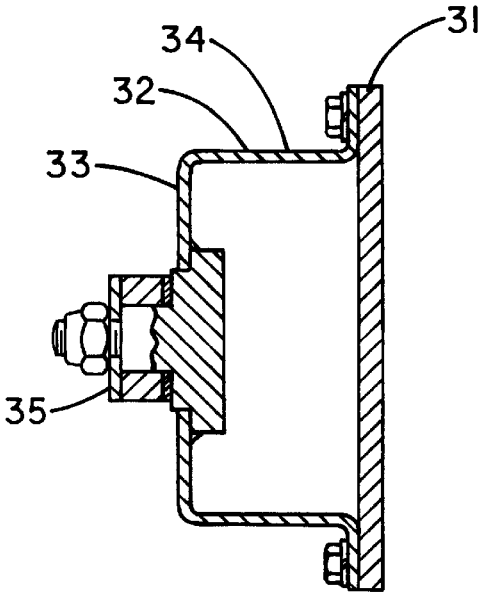
FIG. 3 is a schematic cross-sectional view of the present invention taken from line 3—3 of FIG. 1.
Figure 4:
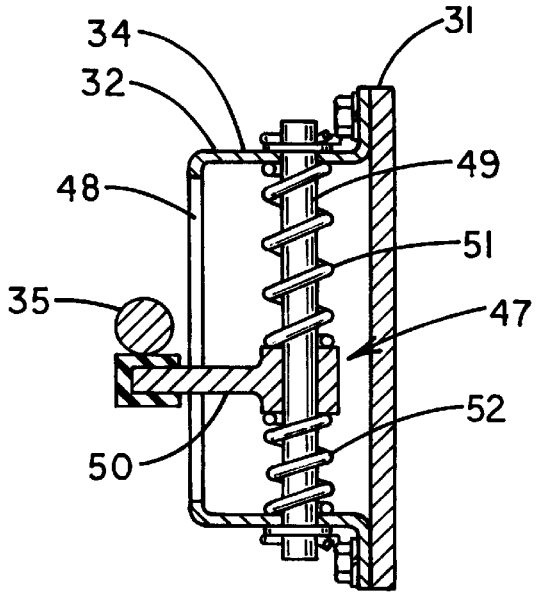
FIG. 4 is a schematic cross sectional view of the present invention taken from line 4–4 of FIG. 1.
Figure 5:
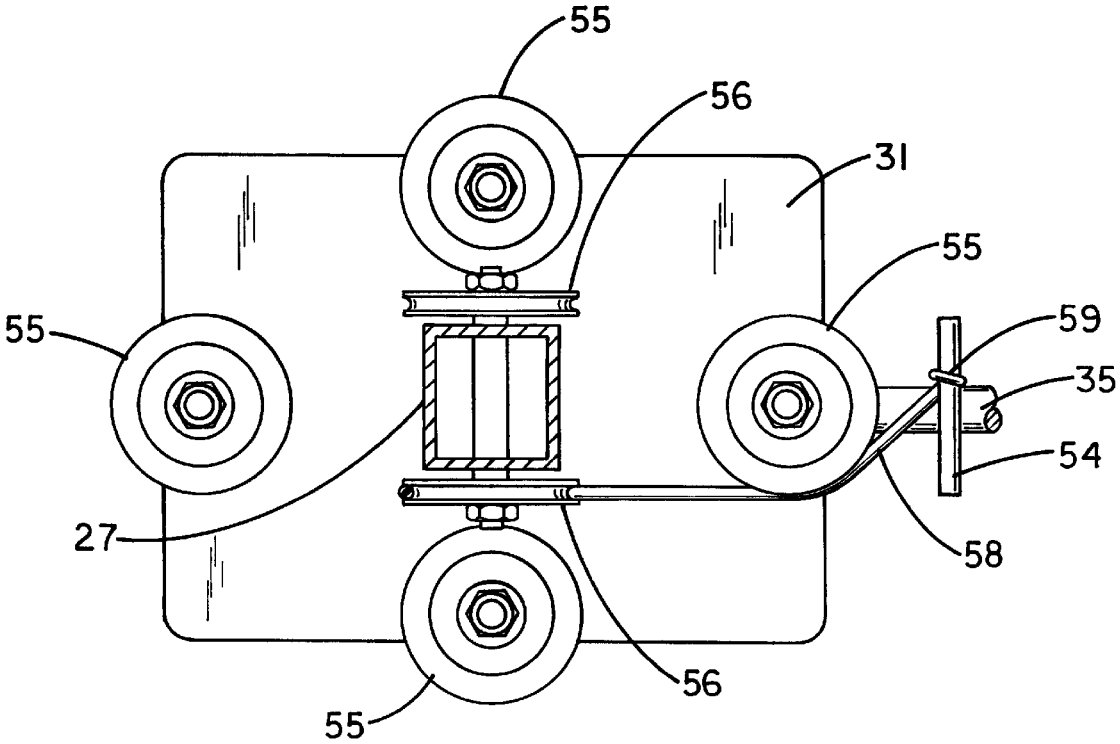
FIG. 5 is a schematic sectional view of the present invention taken from the vantage of line 5—5 of FIG. 2.

With reference to FIGS. 3, 4, and 5, the pulley mounting plate 31 is generally rectangular and has upper and lower surfaces, a pair of end edges, and a pair of side edges extending between the end edges of the pulley mounting plate 31. The lower surface of the pulley mounting plate 31 is coupled to the upper end of the support leg 27. The upper mounting housing 32 is generally rectangular and has a top panel 33 and a perimeter side wall 34. The top panel 33 and the perimeter side wall 34 of the upper mounting housing 32 defines an interior space. The top panel 33 of the upper mounting housing 32 has a pair of ends and a pair of sides extending between the ends. The ends and sides of the top panel 33 define the perimeter of the top panel 33. The perimeter side wall 34 of the upper mounting housing 32 side is downwardly extended around the perimeter of the top panel 33 of the upper mounting housing 32 so that the perimeter side wall 34 has a pair of end panels and a pair side panels extending between the end panels of the perimeter side wall 34. The perimeter side wall 34 of the upper mounting housing 32 is coupled to the upper surface of the pulley mounting plate 31.

Figure 2:
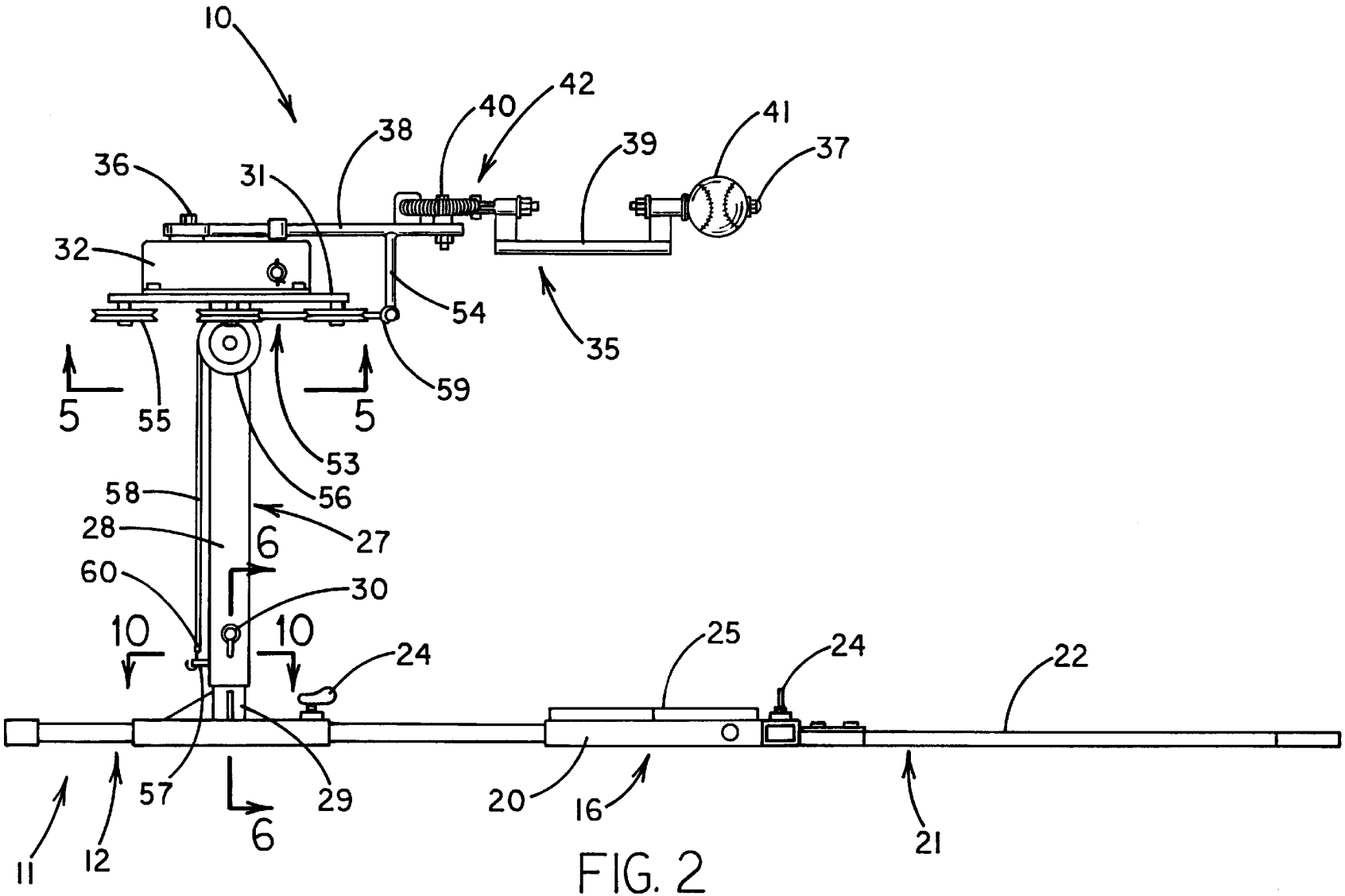
FIG. 2 is a schematic side view of the present invention.
Figure 7:
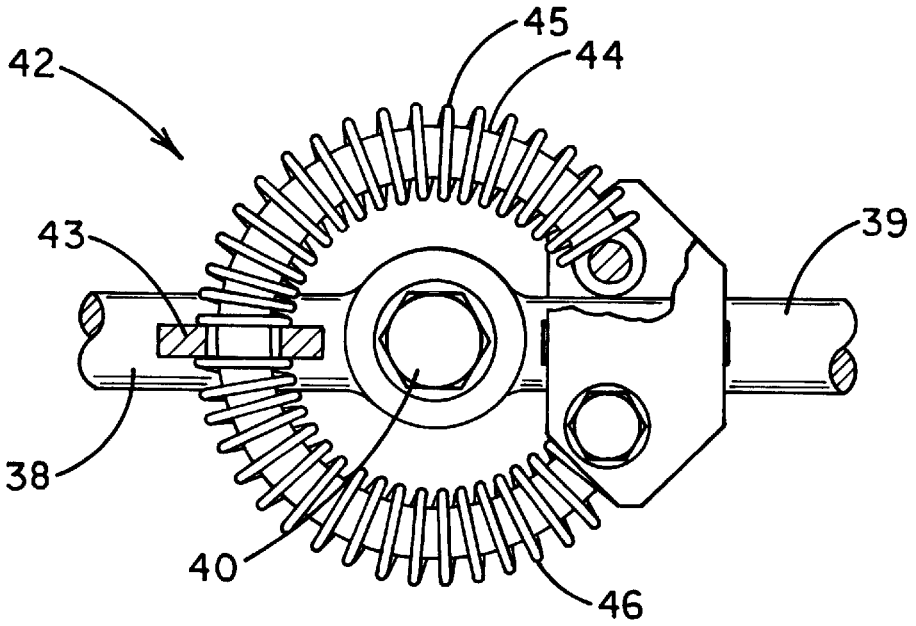
FIG. 7 is a schematic partial sectional view of the pivot arm of the present invention.

With reference to FIGS. 1 and 2, the pivot arm 35 has proximal and distal ends 36,37. The proximal end 36 of the pivot arm 35 is pivotally coupled to the top panel 33 of the upper mounting housing 32. The pivot arm 35 is extendable along a straight line extending generally parallel to the sides of the mounting housing 32 such that the distal end 37 extends in direction towards the second end frame 21 and such that the distal end 37 of the pivot arm 35 is positioned over the home plate member 25. The straight line of the pivot arm 35 is generally parallel to the plane of the base frame 11. With reference to FIG. 7, the pivot arm 35 has proximal and distal portions 38,39 pivotally coupled together at a joint 40 to permit pivoting of the portions at an angle from the straight line of the pivot arm 35. The proximal portion 38 of the pivot arm 35 is positioned adjacent the proximal end 36 of the pivot arm 35. The distal portion 39 of the pivot arm 35 is positioned adjacent the distal end 37 of the pivot arm 35. A baseball 41 is coupled to the distal end 37 of the pivot arm 35. In use, the baseball 41 is designed for striking with a bat by a user standing on the stage platform 22.

In use, a user hits the ball with a bat while standing on the stage plat form. This causes the pivot arm to pivot away from the straight line and also pivots portions of the pivot arm at the joint. A number of biasing assemblies are provided for bringing the pivot arm 35 to a straight length along its straight line to position the baseball 41 over the home plate member 25 after the baseball 41 has been struck by a bat by the user. With reference to FIG. 1, a first biasing assembly 42 is provided for biasing the portions of the pivot arm 35 towards the straight line of the pivot arm 35 such that the portions of the pivot arm 35 are collinear with each other. The first biasing assembly 42 comprises a guide loop 43 coupled to the proximal portion 38 of the pivot arm 35. The guide loop 43 is positioned adjacent the joint 40 of the pivot arm 35. The first biasing assembly also includes generally C-shaped guide rod 44 having a pair of ends, and a central space. The ends of the guide rod 44 are coupled to the distal portion 39 of the pivot arm 35 adjacent the joint 40 of the pivot arm 35 such that a pivot axis of the joint 40 of the pivot arm 35 extends through the central space of the guide rod 44. The guided rod is also extended through the guide loop 43. The first biasing assembly further includes a pair of springs 45,46 disposed around the guide rod 44 with one of the springs positioned between one of the ends of the guide rod 44 and the guide loop 43 and the other spring positioned between another of the ends of the guide rod 44 and the guide loop 43. These springs 45,46 bias the portions of the pivot arm 35 back towards the straight line of the pivot arm 35 when the portions of the pivot arm 35 are pivoted away from the straight line of the pivot arm 35.

A second biasing assembly 47 is also provided for biasing the proximal portion 38 of the pivot arm 35 towards the straight line when the proximal portion 38 of the pivot arm 35 is pivoted away from the straight line. With reference to FIG. 4, the second biasing assembly 47 comprises a slot in the top panel 33 of the mounting housing 32. The slot 48 has a length extending between the sides of the top panel 33 of the mounting housing 32. The second biasing assembly 47 also has a spring rod 49 disposed in the interior space of the mounting housing 32. The spring rod 49 has a length extending between the side panels of the perimeter side wall 34. An extension rod 50 is slidably mounted on the spring rod 49. The extension rod 50 is extended through the slot 48 of the top panel 33 of the mounting housing 32. As illustrated in FIGS. 1 and 4, the extension rod 50 abuts the proximal portion 38 of the pivot arm 35. In use, the extension rod 50 is positionable on either side of the pivot arm 35 depending on the side which the batter is striking from. In use, the extension rod 50 is positioned on the side of the pivot arm 35 facing the direction in which the pivot arm 35 is to pivoted, that is, opposite the side of the ball 41 is struck by the batter. A pair of springs 51,52 are disposed around the spring rod 49 so that the extension rod 50 is interposed between the springs around the spring rod 49. In use, the extension rod 50 is pushed by the pivot arm 35 towards one of the ends of the slot 48 when the pivot arm 35 is pivoted. The springs bias the extension rod 50 back to a point between the side panels of the perimeter side wall 34 so that the extension rod 50 pushes the pivot arm 35 back towards the straight line position.

A third biasing assembly 53 is additionally included for biasing the proximal portion 38 of the pivot arm 35 towards the straight line when the proximal portion 38 of the pivot arm 35 is pivoted away from the straight line. The third biasing assembly 53 comprises an extension rod 54 that is downwardly extended from the proximal portion 38 of pivot arm 35. The extension rod 54 has a lower free end. As illustrated in FIG. 5, the mounting plate 31 has a plurality of pulleys 55 rotatably mounted to the lower surface of the pulley mounting plate 31 with a pulley positioned adjacent each edge of the pulley mounting plate 31. A pair of guide pulleys 56 are rotatably mounted to the support leg 27. The guide pulleys 56 are positioned adjacent the upper end of the support leg 27. At least one mounting loop 57 is coupled to the support leg 27. Preferably, the mounting loop comprises a plate having a pair of loop holes therethrough. The mounting loop 57 is positioned towards the lower end of the support leg 27. An elongate resiliently elastic cable 58 is provided having a pair of opposite ends. One of the ends 59 of the cable 58 is coupled to the free end of the extension rod 54. The cable 58 is looped around at least one of the pulleys 55 of the pulley mounting plate 31 and one of the guide pulleys 56 with the looping around the pulleys depending on which way the pivot arm 35 is struck by the batter. The other end 60 of the cable 58 is detachably coupled by a hook or spring bolt hook to the mounting loop 57. In use, the cable 58 biases the pivot arm 35 back towards the straight line after the pivot arm 35 has been pivoted away from the straight line when struck by the bat of a user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A ball hitting practice device, comprising:

a base frame for resting on a ground surface a base plate being slidably mounted to said base frame;

a telescopically extendable elongate support leg being upwardly extended from said base plate, said support leg having upper and lower ends and a length extending between said ends of said support leg, said lower end of said support leg being coupled to said base plate, said length of said support leg being extended substantially perpendicularly to said base frame;

a pulley mounting plate being generally rectangular and having upper and lower surfaces, a pair of end edges, and a pair of side edges extending between said end edges of said pulley mounting plate, said lower surface of said pulley mounting plate being coupled to said upper end of said support leg;

an upper mounting housing being generally rectangular and having a top panel and a perimeter side wall, said top panel and said perimeter side wall of said upper mounting housing defining an interior space;

said top panel of said upper mounting housing having a pair of ends and a pair of sides extending between said ends, said ends and sides of said top panel defining perimeter of said top panel;

said perimeter side wall of said upper mounting housing side being downwardly extended around said perimeter of said top panel of said upper mounting housing, said perimeter side wall having a pair of end panels and a pair side panels extending between said end panels of said perimeter side wall;

said perimeter side wall of said upper mounting housing being coupled to said upper surface of said pulley mounting plate;

a pivot arm having proximal and distal ends, said proximal end of said pivot arm being pivotally coupled to said top panel of said upper mounting housing;

said pivot arm being extendable along a straight line extending generally parallel to said sides of said mounting housing;

said pivot arm having proximal and distal portions pivotally coupled together at a joint, said proximal portion of said pivot arm being positioned adjacent said proximal end of said pivot arm, said distal portion of said pivot arm being positioned adjacent said distal end of said pivot arm;

a ball being coupled to said distal end of said pivot arm; and said pivot arm being biased towards said straight line when pivot arm is pivoted away from said straight line.

2. The ball hitting practice device of claim 1, wherein said base frame has a first end frame, a second end frame, and a middle frame interposed between said first and second end frames.

3. The ball hitting practice device of claim 2, wherein said first end frame has an elongate end rail and a pair of spaced apart elongate side rails extending from said end rail of said first end frame, wherein said end rail of said first end frame has a length, and wherein said side rails of said first end frame each have a pair of opposite ends and a length extending between said ends of said side rail, one of said ends of each of said side rails of said first end frame being coupled to said end rail of said first end frame, said lengths of said side rails of said first end frame being generally parallel to each other, said lengths of said side rails of said first end frame being generally perpendicular to said length of said end rail of said first end frame.

4. The ball hitting practice device of claim 3, wherein said middle frame is generally rectangular and has a pair of end bars and a pair of side bars between said end bars of said middle frame, each of said bars of said middle frame having a length, said middle frame having a pair of holes, one hole of said middle frame extending into each of said side bars, said holes being positioned adjacent one of said end bars of said middle frame, another of said ends of one of said side rails of said first frame being inserted into one of said holes of said middle frame, another of said ends of said another of said side rails of said first frame being inserted into another of said holes of said middle frame.

5. The ball hitting practice device of claim 4, wherein said middle frame has a bore extending through another of said end bars between said side bars of said middle frame, and wherein said second end frame has a stage platform and an elongate slide rod, wherein said stage platform of said second end frame is generally rectangular and having a generally planar upper surface, a pair of end edges and a pair of side edges extending between said end edges of said stage platform, wherein said slide rod of said second end platform has pair of opposite ends, said slide rod being extended through said bore of said middle frame, said ends of said slide rod of said second end frame being coupled to one of said side edges of said stage platform of said second end frame.

6. The ball hitting practice device of claim 4, further comprising a home plate member, said home plate member resting on said middle frame, said home plate member being pivotally coupled to said middle frame.

7. The ball hitting practice device of claim 1, further comprising a first biasing assembly for biasing said portions of said pivot arm towards said straight line of said pivot arm such that said portions of said pivot arm are collinear with each other, said first biasing assembly comprising:

a guide loop being coupled to said proximal portion of said pivot arm, said guide loop being positioned adjacent said joint of said pivot arm;

a generally C-shaped guide rod having a pair of ends, and a central space, said ends of said guide rod being coupled to said distal portion of said pivot arm adjacent said joint of said pivot arm such that a pivot axis of said joint of said pivot arm extends through said central space of said guide rod, said guided rod being extended through said guide loop; and a pair of springs being disposed around said guide rod, one of said springs being positioned between one of said ends of said guide rod and said guide loop, another of said springs being positioned between another of said ends of said guide rod and said guide loop, said springs biasing said portions of said pivot arm towards said straight line of said pivot arm when said portions of said pivot arm are pivoted away from said straight line of said pivot arm.

8. The ball hitting practice device of claim 1, further comprising a second biasing assembly for biasing said proximal portion of said pivot arm towards said straight line when said proximal portion of said pivot arm is pivoted away from said straight line, said second biasing assembly comprising:

said top panel of said mounting housing having a slot therethrough, said slot having a length extending between said sides of said top panel of said mounting housing;

a spring rod being disposed in said interior space of said mounting housing, said spring rod having a length extending between said side panels of said perimeter side wall;

an extension rod being slidably mounted on said spring rod, said extension rod being extended through said slot of said top panel of said mounting housing;

said extension rod abutting said proximal portion of said pivot arm; and a pair of springs being disposed around said spring rod, said extension rod being interposed between said springs around said spring rod.

9. The ball hitting practice device of claim 1, further comprising a third biasing assembly for biasing said proximal portion of said pivot arm towards said straight line when said proximal portion of said pivot arm is pivoted away from said straight line, said third biasing assembly comprising:

an extension rod being downwardly extended from said proximal portion of pivot arm, said extension rod having a lower free end;

said mounting plate having a plurality of pulleys rotatably mounted to said lower surface of said pulley mounting plate, a pulley being positioned adjacent each edge of said pulley mounting plate;

a pair of guide pulleys being rotatably mounted to said support leg, said guide pulleys being positioned adjacent said upper end of said support leg;

a mounting loop being coupled to said support leg, said mounting loop being positioned towards said lower end of said support leg; and an elongate resiliently elastic cable having a pair of opposite ends, one of said ends of said cable being coupled to sad free end of said extension rod, said cable being looped around at least one of said pulleys of said pulley mounting plate and one of said guide pulleys, another of said ends of said cable being detachably coupled to said mounting loop.

10. A ball hitting practice device, comprising:

a base frame for resting on a ground surface, said base frame having a first end frame, a second end frame, and a middle frame interposed between said first and second end frames;

said first end frame having an elongate end rail and a pair of spaced apart elongate side rails extending from said end rail of said first end frame;

said end rail of said first end frame having a length;

said side rails of said first end frame each having a pair of opposite ends and a length extending between said ends of said side rail, one of said ends of each of said side rails of said first end frame being coupled to said end rail of said first end frame, said lengths of said side rails of said first end frame being generally parallel to each other, said lengths of said side rails of said first end frame being generally perpendicular to said length of said end rail of said first end frame;

said middle frame being generally rectangular and having a pair of end bars and a pair of side bars between said end bars of said middle frame, each of said bars of said middle frame having a length;

said middle frame having a pair of holes, one hole of said middle frame extending into each of said side bars, said holes being positioned adjacent one of said end bars of said middle frame, another of said ends of one of said side rails of said first frame being inserted into one of said holes of said middle frame, another of said ends of said another of said side rails of said first frame being inserted into another of said holes of said middle frame;

said middle frame having a bore extending through another of said end bars between said side bars of said middle frame;

said second end frame having a stage platform and an elongate slide rod;

said stage platform of said second end frame being generally rectangular and having a generally planar upper surface, a pair of end edges and a pair of side edges extending between said end edges of said stage platform;

said slide rod of said second end platform having pair of opposite ends, said slide rod being extended through said bore of said middle frame, said ends of said slide rod of said second end frame being coupled to one of said side edges of said stage platform of said second end frame;

a home plate member, said home plate member resting on said middle frame, said home plate member being pivotally coupled to said middle frame;

a base plate being slidably mounted on said side rails of said first end frame;

a telescopically extendable elongate support leg being upwardly extended from said base plate, said support leg having upper and lower ends and a length extending between said ends of said support leg, said lower end of said support leg being coupled to said base plate, said length of said support leg being extended substantially perpendicularly to said base frame;

a pulley mounting plate being generally rectangular and having upper and lower surfaces, a pair of end edges, and a pair of side edges extending between said end edges of said pulley mounting plate, said lower surface of said pulley mounting plate being coupled to said upper end of said support leg;

an upper mounting housing being generally rectangular and having a top panel and a perimeter side wall, said top panel and said perimeter side wall of said upper mounting housing defining an interior space;

said top panel of said upper mounting housing having a pair of ends and a pair of sides extending between said ends, said ends and sides of said top panel defining perimeter of said top panel;

said perimeter side wall of said upper mounting housing side being downwardly extended around said perimeter of said top panel of said upper mounting housing, said perimeter side wall having a pair of end panels and a pair side panels extending between said end panels of said perimeter side wall;

said perimeter side wall of said upper mounting housing being coupled to said upper surface of said pulley mounting plate;

a pivot arm having proximal and distal ends, said proximal end of said pivot arm being pivotally coupled to said top panel of said upper mounting housing;

said pivot arm being extendable along a straight line extending generally parallel to said sides of said mounting housing such that said distal end of said pivot arm is positioned over said home plate member;

said pivot arm having proximal and distal portions pivotally coupled together at a joint, said proximal portion of said pivot arm being positioned adjacent said proximal end of said pivot arm, said distal portion of said pivot arm being positioned adjacent said distal end of said pivot arm;

a ball being coupled to said distal end of said pivot arm;

a first biasing assembly for biasing said portions of said pivot arm towards said straight line of said pivot arm such that said portions of said pivot arm are collinear with each other, said first biasing assembly comprising:

a guide loop being coupled to said proximal portion of said pivot arm, said guide loop being positioned adjacent said joint of said pivot arm;

a generally C-shaped guide rod having a pair of ends, and a central space, said ends of said guide rod being coupled to said distal portion of said pivot arm adjacent said joint of said pivot arm such that a pivot axis of said joint of said pivot arm extends through said central space of said guide rod, said guided rod being extended through said guide loop; and a pair of springs being disposed around said guide rod, one of said springs being positioned between one of said ends of said guide rod and said guide loop, another of said springs being positioned between another of said ends of said guide rod and said guide loop, said springs biasing said portions of said pivot arm towards said straight line of said pivot arm when said portions of said pivot arm are pivoted away from said straight line of said pivot arm;

a second biasing assembly for biasing said proximal portion of said pivot arm towards said straight line when said proximal portion of said pivot arm is pivoted away from said straight line, said second biasing assembly comprising:

said top panel of said mounting housing having a slot therethrough, said slot having a length extending between said sides of said top panel of said mounting housing;

a spring rod being disposed in said interior space of said mounting housing, said spring rod having a length extending between said side panels of said perimeter side wall;

an extension rod being slidably mounted on said spring rod, said extension rod being extended through said slot of said top panel of said mounting housing;

said extension rod abutting said proximal portion of said pivot arm; and a pair of springs being disposed around said spring rod, said extension rod being interposed between said springs around said spring rod; and a third biasing assembly for biasing said proximal portion of said pivot arm towards said straight line when said proximal portion of said pivot arm is pivoted away from said straight line, said third biasing assembly comprising:

an extension rod being downwardly extended from said proximal portion of pivot arm, said extension rod having a lower free end;

said mounting plate having a plurality of pulleys rotatably mounted to said lower surface of said pulley mounting plate, a pulley being positioned adjacent each edge of said pulley mounting plate;

a pair of guide pulleys being rotatably mounted to said support leg, said guide pulleys being positioned adjacent said upper end of said support leg;

a mounting loop being coupled to said support leg, said mounting loop being positioned towards said lower end of said support leg; and an elongate resiliently elastic cable having a pair of opposite ends, one of said ends of said cable being coupled to sad free end of said extension rod, said cable being looped around at least one of said pulleys of said pulley mounting plate and one of said guide pulleys, another of said ends of said cable being detachably coupled to said mounting loop.

* * * * *